US009475608B2

(12) United States Patent
Dye et al.

(10) Patent No.: US 9,475,608 B2
(45) Date of Patent: Oct. 25, 2016

(54) PALLETIZED SHIPPING AND DISPLAY SYSTEM

(71) Applicant: INTERNATIONAL PAPER COMPANY, Memphis, TN (US)

(72) Inventors: Robert Dye, Montebello, NY (US); Marco Cerqueira, Nutley, NJ (US)

(73) Assignee: International Paper Company, Memphis, TN (US)

( * ) Notice: Subject to any disclaimer, the term of this patent is extended or adjusted under 35 U.S.C. 154(b) by 336 days.

(21) Appl. No.: 14/229,023

(22) Filed: Mar. 28, 2014

(65) Prior Publication Data

US 2015/0274360 A1 Oct. 1, 2015

(51) Int. Cl.

| | |
|---|---|
| ***B65D 19/44*** | (2006.01) |
| ***B65D 19/00*** | (2006.01) |
| ***B65D 19/20*** | (2006.01) |
| ***B65D 77/04*** | (2006.01) |
| ***B65D 5/52*** | (2006.01) |

(52) U.S. Cl.

CPC ..... *B65D 19/44* (2013.01); *B65D 5/526* (2013.01); *B65D 19/004* (2013.01); *B65D 19/20* (2013.01); *B65D 77/042* (2013.01); *B65D 77/0413* (2013.01); *B65D 2519/00034* (2013.01); *B65D 2519/00069* (2013.01); *B65D 2519/0096* (2013.01); *B65D 2519/00268* (2013.01); *B65D 2519/00298* (2013.01); *B65D 2519/00338* (2013.01); *B65D 2519/00796* (2013.01); *B65D 2519/00815* (2013.01)

(58) Field of Classification Search

CPC .. B65D 5/526; B65D 5/5266; B65D 5/5206; B65D 5/52; B65D 19/20; B65D 19/06; B65D 19/04; B65D 19/02; B65D 19/44; B65D 77/0413; B65D 77/042; B65D 77/385

See application file for complete search history.

(56) References Cited

U.S. PATENT DOCUMENTS

| | | | | |
|---|---|---|---|---|
| 3,664,494 | A * | 5/1972 | Mergens | B65D 5/2038 206/45.2 |
| 4,079,566 | A | 3/1978 | Stoecklin | |
| 4,185,763 | A | 1/1980 | Geraedts | |
| 4,445,614 | A * | 5/1984 | Mitsumori | B65D 19/0016 108/53.1 |
| 4,454,946 | A | 6/1984 | Yokowo | |
| 4,697,699 | A * | 10/1987 | Schneider | B65D 19/20 108/51.3 |
| 4,765,252 | A | 8/1988 | Shuert | |
| 4,936,451 | A | 6/1990 | Shuert | |
| 5,370,233 | A | 12/1994 | Schutz et al. | |

(Continued)

FOREIGN PATENT DOCUMENTS

| | | |
|---|---|---|
| AU | 2010269108 | 1/2011 |
| WO | 2004108541 | 12/2004 |

*Primary Examiner* — Steven A. Reynolds
*Assistant Examiner* — Javier A Pagan
(74) *Attorney, Agent, or Firm* — Matthew M. Eslami

(57) ABSTRACT

The palletized shipping and display system comprises two support containers, a plastic pallet, a product tray, a tubular sleeve, and a plurality of product containers that are disposed in the support containers. The support containers are latched at their bottoms to the pallet. Each of the support containers includes an open front and a shelf recessed from an open top and the tubular sleeve disposed around the support and product containers. A display chamber is defined in the open top above the shelf for displaying product at a point of sale and when the product is depleted from the display chamber, the sleeve is lifted to expose and retrieve product containers from the bottom of the stack. The retrieved product containers are then used to replenish product in the display chamber.

17 Claims, 7 Drawing Sheets

(56) References Cited

U.S. PATENT DOCUMENTS

| | | | |
|---|---|---|---|
| RE35,875 | E | 8/1998 | Shuert |
| 5,896,995 | A | 4/1999 | Murray et al. |
| 6,050,419 | A | 4/2000 | Flanagan et al. |
| 7,284,662 | B2 | 10/2007 | Debusk et al. |
| 8,056,727 | B1 | 11/2011 | Marsh |
| 8,424,681 | B1 | 4/2013 | Schonhardt et al. |

* cited by examiner

PALLETIZED SHIPPING AND DISPLAY SYSTEM

FIELD OF THE INVENTION

The present invention relates generally to a system for packaging, shipping and displaying a plurality of products. More particularly, the invention is a packaging system in which a plurality of product container are stacked in at least one support container that is latched at its bottom end to a pallet.

BACKGROUND OF THE INVENTION

Combination of corrugated paperboard containers and a pallet are well known in the art. It is known to provide assemblies which are utilized to both transport and provide point of purchase merchandizing capabilities. For example, U.S. Pat. No. 5,370,233 issued on Dec. 6, 1994 discloses a product shipping and display assembly that includes a tray, a sleeve positioned in the tray and a plurality of packages stacked in the sleeve element on the tray. Other patents representative of the prior art are the following U.S. Pat. No. 3,664,494 issued on May 23, 1972, U.S. Pat. No. 4,454,946 issued on Jun. 19, 1984, U.S. Pat. No. 6,050,419 issued on Apr. 18, 2000, and U.S. Pat. No. 8,424,681 issued on Apr. 23, 2013. However, all of the products made under cited art have serious drawbacks in a food packaging environment as they may contaminate the products with splinters or metal fasteners.

Therefore, it would be desirable to provide a palletized shipping and display system in which a plurality of product containers are stacked in at least one support container that is latched at its bottom end to a pallet.

SUMMARY OF THE INVENTION

The palletized shipping and display system of the present invention comprises at least one support container, a plastic pallet, a product tray, an open-ended tubular sleeve, and a plurality of product containers that are disposed in the at least one support container. The at least one support container is latched at its bottom to the pallet. In the preferred embodiment of the invention, there are two support containers, each of which is latched at its bottom to the pallet. The support container includes an open front and a shelf recessed from an open top with the open-ended sleeve disposed around the support and product containers. A display chamber is defined in the open top above the shelf for displaying product at a point of sale and when the product is depleted from the display chamber, the sleeve is lifted to expose and retrieve product containers from the bottom of the stack. The retrieved product containers are then used to replenish product in the display chamber.

Accordingly, one aspect of the present invention is directed to a palletized shipping and display system comprises a pallet and at least one support container is supported on top of the pallet. The at least one support container includes opposite side walls, a back wall, an open front, an open top, and a horizontal shelf extending between the side walls and spaced below the open top to define a product display chamber at the open top. Detent means on a bottom end of the at least one support container are used for cooperation with complementary detent means on the pallet to hold the at least one support container to the pallet. A plurality of product containers is stacked in the support container. An open-ended tubular sleeve is disposed around the at least one support container and the stacked product containers. The open-ended tubular sleeve is supported at a lower end on the pallet and extending at an upper end to the open top. The open-ended tubular sleeve is closing the open front to retain the stacked product containers in place while leaving the display chamber exposed through the open top. The open-ended tubular sleeve is slidable upwardly to enable product containers to be withdrawn from the bottom of the stacked product containers and placed in the display chamber as product is depleted from the display chamber.

Another aspect of the present invention is directed to a palletized shipping and display system comprises a pallet including a plurality of channels each of which have a plurality of spaced apart integrated clips formed therein. Two support containers each of which contagiously is supported on top of the pallet and having respective opposite side walls, respective back walls, respective open fronts, respective open tops, and respective horizontal shelves extending between the respective side walls and spaced below the respective open top to define a product display chamber at the respective open top. Detent means on a bottom end of each of the two support containers for cooperation with complementary detent means on the pallet to hold the at least one support container to the pallet. A product tray containing products is configured to be placed in the product display chamber. A plurality of product containers are stacked in the respective support containers. An open-ended tubular sleeve is disposed around the two support containers, the stacked product containers and the product tray. The open-ended tubular sleeve is supported at a lower end on the pallet and extending at an upper end to the open top. The open-ended tubular sleeve is closing the open front to retain the stacked product containers in place while leaving the display chamber exposed through the open top. The open-ended tubular sleeve is lifted to expose and remove product from the product containers so that to replenish product in the product tray.

One further aspect of the present invention is directed to a palletized shipping and display system comprises a pallet having four channels each of which includes two pairs of spaced apart integrated clips formed therein. First and second support containers each of which contagiously is supported on top of the pallet and having respective opposite side walls, respective back walls, respective open fronts, respective open tops, and respective horizontal shelves extending between the respective side walls and spaced below the respective open top to define a product display chamber at the respective open top. A pair of spaced apart notches is formed on a bottom end of each of the first and second support containers for cooperation with spaced apart integrated clips on the pallet to hold the first and second support containers to the pallet. A product tray containing products is configured to be placed in the product display chamber. A plurality of product containers are stacked in the respective first and second support containers. An open-ended tubular sleeve is disposed around the two support containers, the stacked product containers and the product tray. The open-ended tubular sleeve is supported at a lower end on the pallet and extending at an upper end to the open top. The open-ended tubular sleeve is closing the open front to retain the stacked product containers in place while leaving the display chamber exposed through the open top, the open-ended tubular sleeve is lifted to expose and remove product from the product containers so that to replenish product in the product tray.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
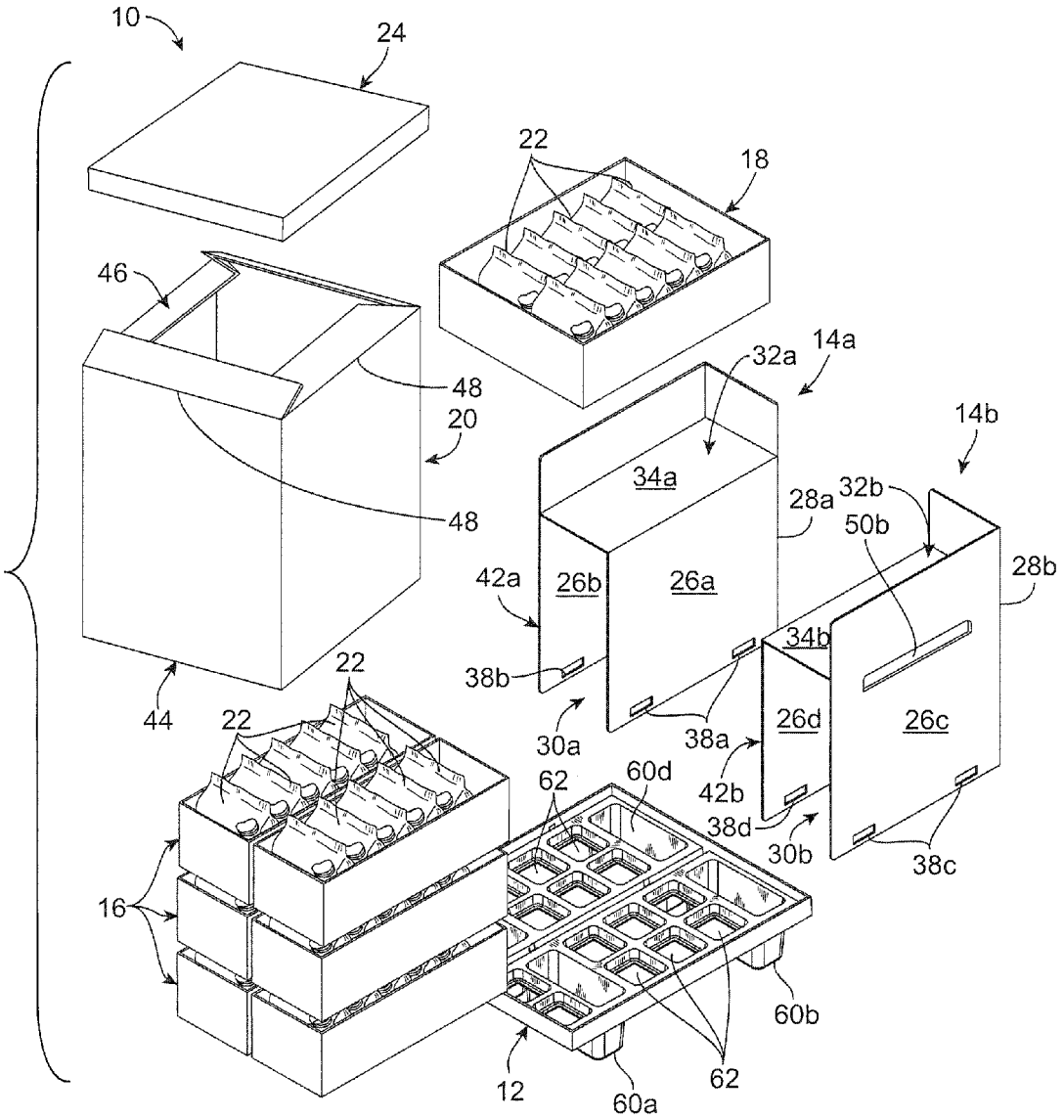
FIG. 1 is an exploded perspective view of a palletized shipping and display system having a plurality of product containers, a pallet, two support containers, and a product tray in a spaced relationship with one another in accordance to the preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same.

Figure 2C:
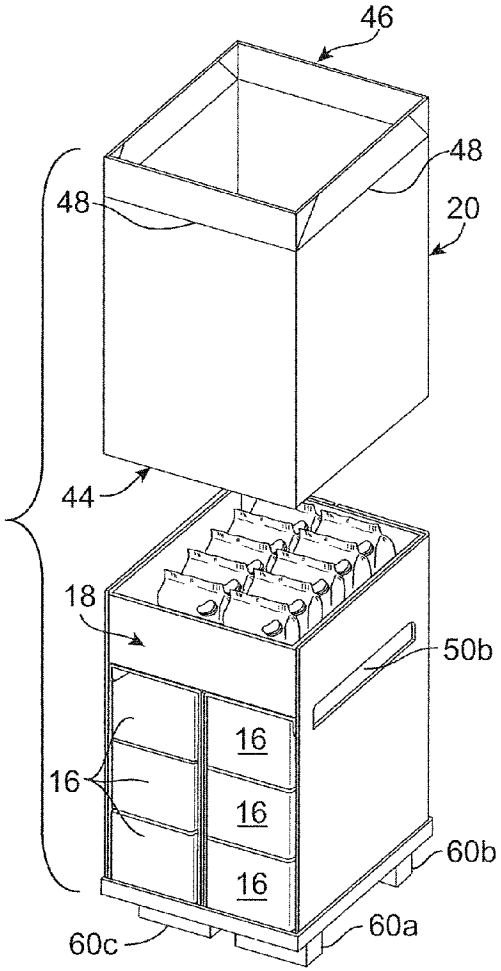
FIG. 2C is a top perspective view of the pallet, the plurality of product containers, the two support containers, and the product tray in an assembled position with the open-ended tubular sleeve in spaced relationship with thereof.
Figure 2B:
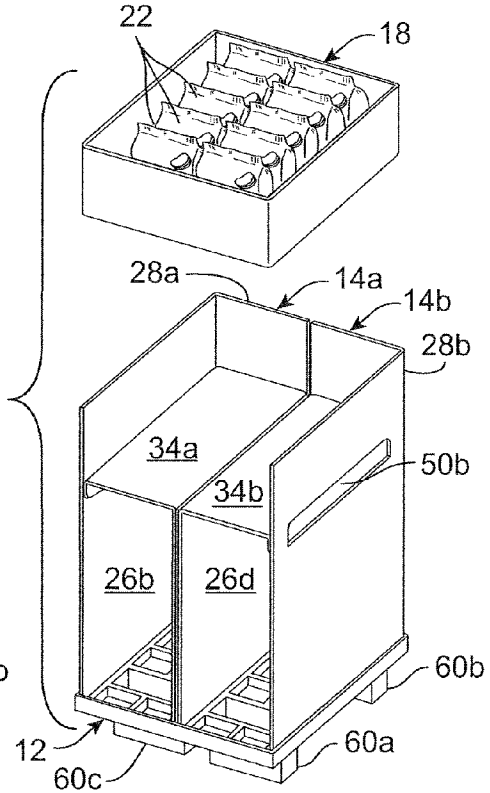
FIG. 2B is a top perspective view of the tray product in the spaced relationship with the two support containers in FIG. 2A each of which is latched at its bottom to the pallet.
Figure 2A:
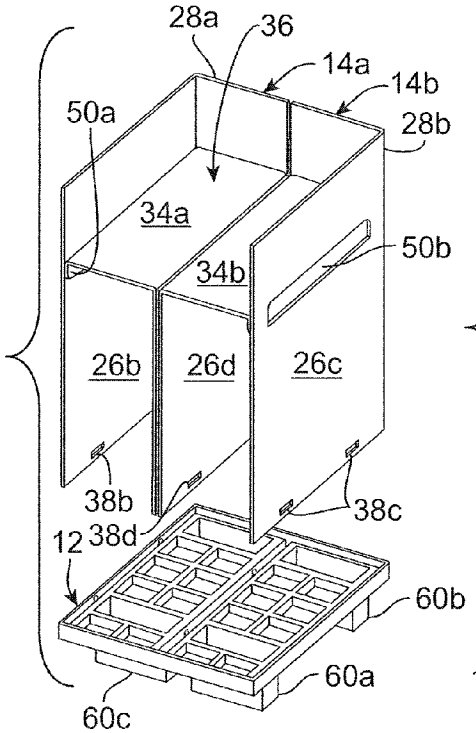
FIG. 2A is a top exploded perspective view of the two support containers in a contiguous position with one another and in the spaced relationship with the pallet.

FIG. 1 is an exploded perspective view of a palletized shipping and display system 10 comprises a pallet 12, first and second support containers 14*a*, 14*b*, a plurality of product containers 16 containing products 22, an open-ended tubular sleeve 20, a product tray 18 containing products 22, and a shipping lid 24. Each of the first and second support containers 14*a*, 14*b* are contiguously supported on top of the pallet 12 and each of the first and second support containers 14*a*, 14*b* is latched at its bottom to the pallet 12. In the preferred embodiment of the invention, the product tray 18 is used to display products at the retail store, however, one of ordinary skill in the art would appreciate that two product containers 16 can be used in place of the product tray 18. The first and second support containers 14*a*, 14*b* are structurally the same and mirror image of one another when fully supported by the pallet 12. The respective first and second support containers 14*a*, 14*b* includes respective opposite side walls 26*a*, 26*b*; 26*c*, 26*d*, respective back walls 28*a*, 28*b*, respective open fronts 30*a*, 30*b*, respective open tops 32*a*, 32*b* and respective horizontal shelf 34*a*, 34*b* extending between respective the side walls 26*a*, 26*b*; 26*c*, 26*d* and spaced below the respective open tops 32*a*, 32*b* to define a product display chamber 36 when the respective open tops 32*a*, 32*b* are contiguously supported on top of the pallet 12 as depicted in FIG. 2A. Detent means on a bottom end of the respective first and second support containers 14*a*, 14*b* are used for cooperation with complementary detent means on the pallet 12 to hold the respective first and second support containers 14*a*, 14*b* to the pallet 12. The detent means on the bottom end of the respective first and second support containers 14*a*, 14*b* is a respective pair of spaced apart die cut notches 38*a*, 38*b* and 38*c*, 38*d* formed on respective opposite side walls 26*a*, 26*b*; 26*c*, 26*d*. The detent means on the pallet 12 is a plurality of spaced apart integrated clips 40*a*, 40*b*, and 40*c*formed on the pallet 12 wherein each pair of the integrated clips 40*a*, 40*b*, and 40*c* corresponds to the spaced apart notches 38*a*, 38*b* and 38*c*, 38*d* on the bottom end of the respective first and second support containers 14*a*, 14*b*. As of an ordinary skill in the art would appreciate that the shape and/or location of each notches or clips is not limited to the ones shown in the present invention and other equivalents can be used as detent means on the pallet and the support containers.

Figure 2F:
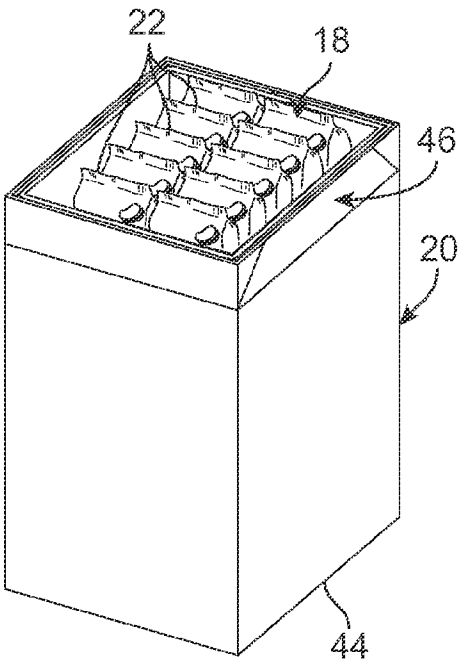
FIG. 2F illustrates the palletized shipping and display system in a display position when the cap is removed, the sleeve is slid down to conceal the pallet, and to display products in a retail store.
Figure 2E:
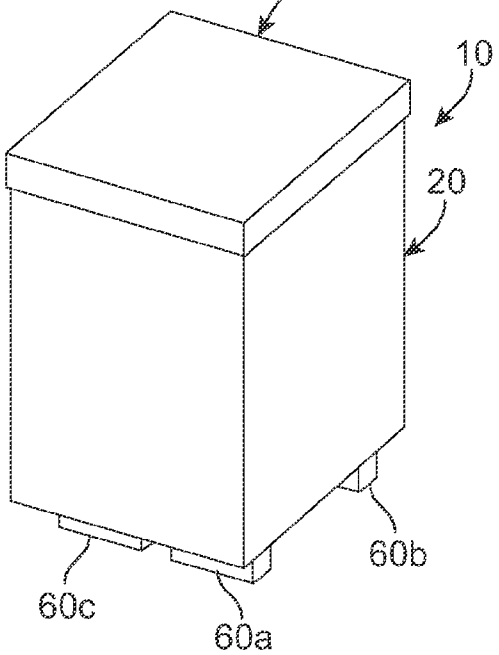
FIG. 2E is similar to FIG. 2D which illustrates the palletized shipping and display system fully assembled in a shipping position.
Figure 2D:
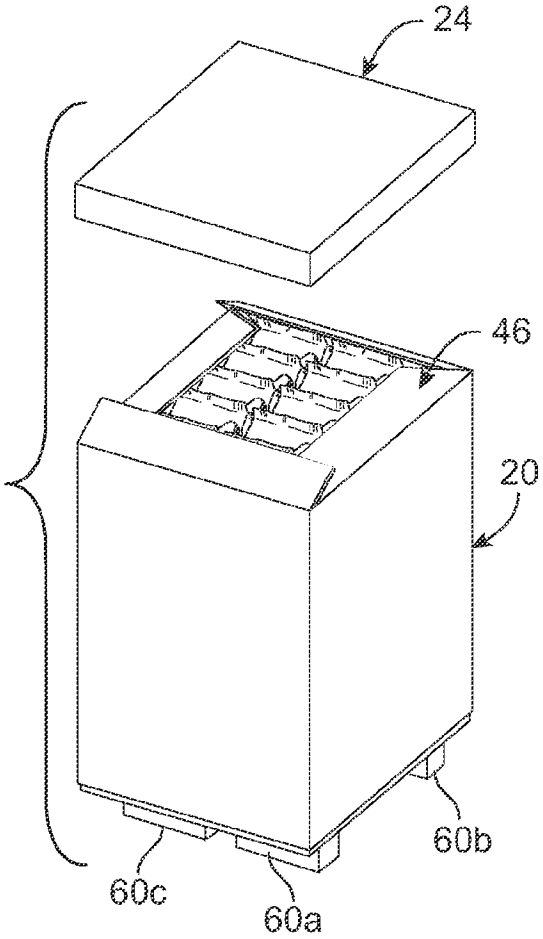
FIG. 2D is a top perspective view of the palletized shipping and display system in the assembled position with the shipping cap in spaced relationship thereof.

A plurality of product containers 16 each of which containing products 22 are disposed inside each of the two contiguous U-shaped storage 42*a* and 42*b* in a stacking manner. As one example in FIG. 1, there are shown three product containers 16 stacked on one another which correspond to the height of the first and second support containers 14*a*, 14*b*. However, one of ordinary skill in the art would appreciate that any number of product containers and/or any number of support containers with a different size or shape can be used. An open-ended tubular sleeve 20 is disposed around the first and second support containers 14*a*, 14*b* and the stacked product containers 16 and is supported at a lower end 44 on the pallet 12 and extending at an upper end 46 to the open tops 32*a*, 32*b*. The upper end 46 is defined by a fold line 48 formed below the free edge on the inside perimeter of the open-ended tubular sleeve 20 so that the upper end 46 can be folded down to secure the sleeve 20 to the first and second support containers 14*a*, 14*b* and the stacked product containers 16 when the palletized shipping and display system 10 is in the shipping position as depicted in FIG. 2D. The open-ended tubular sleeve 20 is closing the open front 30*a*, 30*b* to retain the stacked product containers 16 in place while leaving the display chamber 36 exposed through the open tops 32*a*, 32*b* as depicted in FIG. 2F. As noted above, the product tray 18 containing products 22 sits in the display chamber 36 formed by the open tops 32*a*, 32*b* or alternatively, two of the product containers 16 can be used in place of the product tray 18. The open-ended tubular sleeve 20 is slidable upwardly to enable product containers 16 to be withdrawn from the bottom of the stacked product containers 16 and placed in the display chamber 36 as product is depleted from the display chamber 36. The shipping lid 24 is used to enclose the display chamber 36 for shipping and transportation of the palletized shipping and display system 10. FIGS. 2A-2F illustrates the steps of constructing the palletized shipping and display system 10 based on FIG. 1 and will be discussed in greater detail hereinafter.

Figure 3A:
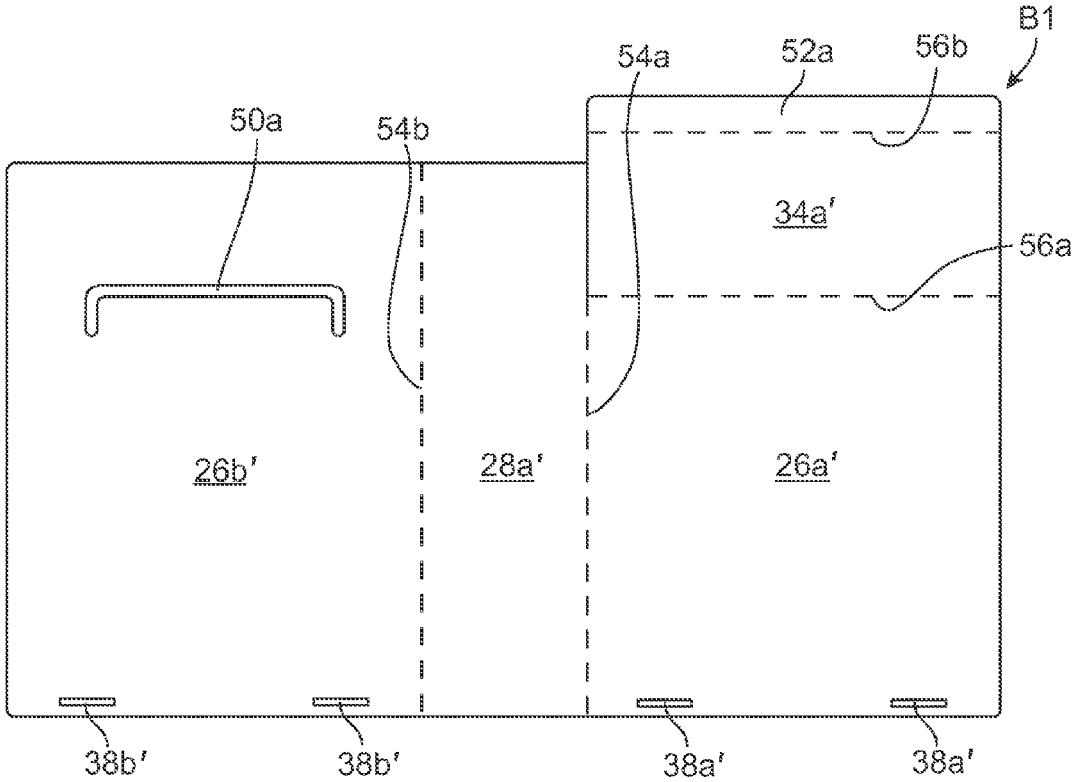
FIG. 3A is a top plan view of a blank B1 for making the first support container shown in FIG. 1.

FIG. 3A is a top plan view of a blank B1 for making the first support container 14*a* shown in FIG. 1. The blank B1 is preferably an integral piece of a material such as continuous sheet of conventional corrugated cardboard. The blank B1 is cut along its outer margins to form its specific shape so that corresponds to the shape of the first support container 14*a*. The blank B1 is divided into the opposite side walls 26*a*', 26*b*' and the back wall 28*a*' via fold lines 54*a* and 54*b*. The back wall 28*a*' is defined by the two fold lines 54*a* and 54*b*. Each of the side walls 26*a*', 26*b*' includes two spaced apart notches 38*a*', 38*a*' and 38*b*', 38*b*' formed in the lower end of the respective side walls 26*a*' and 26*b*'. Although in the preferred embodiment of the invention notches are formed in the side walls 26*a*', 26*b*', one of ordinary skill in the art would appreciate that other means such as slots, slits, grooves and/or apertures can be used and are within the scope of the claimed invention. The side wall 26*a*' further includes an elongated locking tab 52*a* and the horizontal shelf panel 34*a*' which are formed by two spaced apart parallel fold lines 56*a* and 56*b*. The elongated locking tab 52*a* and the side wall 26*a*' have the same width and the elongated locking tab 52*a* extends from one of the free edges of side wall 26*a*'. The horizontal self panel 34*a*' has a length and a width that corresponds to the length and width of the individual product containers 16.

The side wall 26*b*' includes an elongated U-shaped slot 50*a* which is used to receive the elongated locking tab 52*a* when the first support container 14*a* is constructed. The strategic locations of the elongated U-shaped slot 50*a*, the elongated locking tab 52*a* and the horizontal self panel 34*a*', when constructed, provide a length, width, and height for the display chamber 36 that permits the tray 18 or the two of the product containers 16 to be placed therein. To construct blank B1, the side walls 26*a*', 26*b*' are folded along respective fold lines 54*a*, 54*b* so that they are positioned at right angles with respect to the back wall 28*a*'. Next, the horizontal shelf panel 34*a*' and the elongated locking tab 52*a* are simultaneously folded downwardly along the fold line 56*a* such that the elongated locking tab 52*a* is folded along the fold line 56*b* and be inserted into the elongated U-shaped slot 50*a*. The first support container 14*a* is constructed such that the dimension of the open top 32*a* corresponds exactly to the dimension of one of the product containers 16.

Figure 3B:
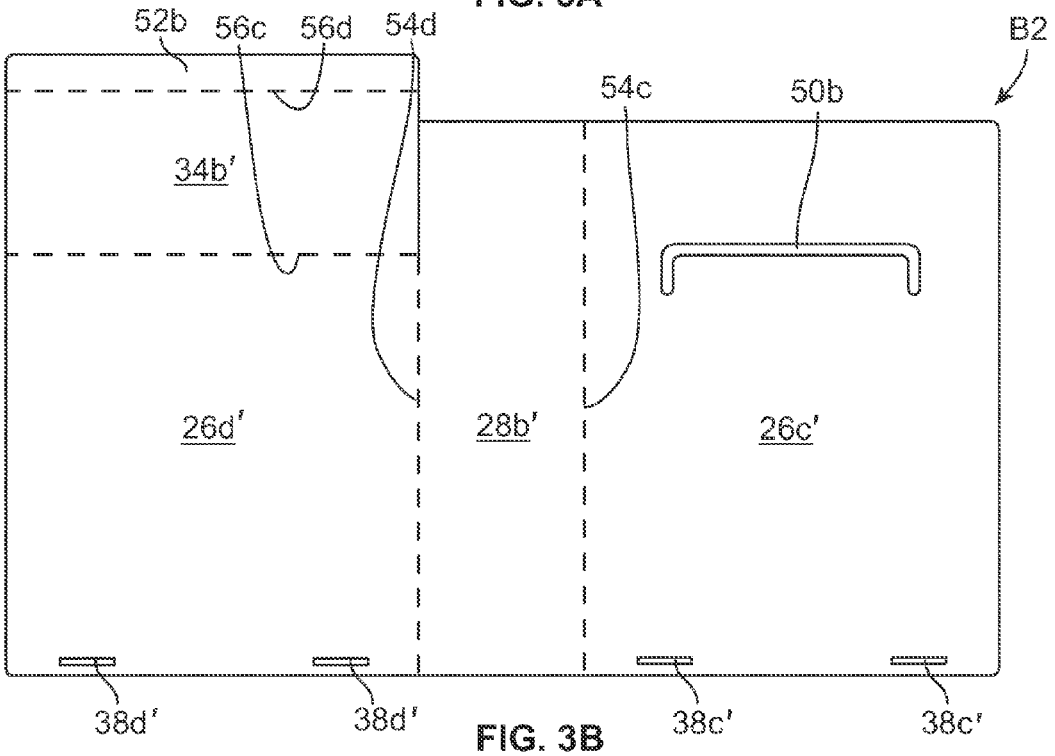
FIG. 3B is a top plan view of a blank B2 for making the second support container shown in FIG. 1.

FIG. 3B is a top plan view of a blank B2 for making the second support container shown in FIG. 1. The blank B2 is preferably an integral piece of a material such as continuous sheet of conventional corrugated cardboard. The blank B2 is cut along its outer margins to form its specific shape so that corresponds to the shape of the first support container 14*b*. The blank B2 is divided into the opposite side walls 26*c*', 26*d*' and the back wall 28*b*' via fold lines 54*c* and 54*d*. The back wall 28*b*' is defined by the two fold lines 54*c* and 54*d*. Each of the side walls 26*c*', 26*d*' includes two spaced apart die cut notches 38*c*', 38*c*' and 38*d*', 38*d*' formed in the lower end of the respective side walls 26*c*' and 26*d*'. Although in the preferred embodiment of the invention notches are formed in the side walls 26*c*', 26*d*' but, one of ordinary skill in the art would appreciate that other means such as slots, slits, grooves and/or apertures can be used and they are within the scope of the claimed invention.

Similarly, the side wall 26*d*' includes an elongated locking tab 52*b* and the horizontal shelf panel 34*b*' which are formed by two spaced apart parallel fold lines 56*c* and 56*d*. The elongated locking tab 52*b* and the side wall 26*a*' have the same width and the locking tab 52*b* extends from one of the free edges of side wall 26*a*'. The horizontal self panel 34*b*' has a length and a width that correspond to the length and width of the individual product containers 16. The side wall 26*c*' includes an elongated U-shaped slot 50*b* which is used to receive the elongated locking tab 52*b* when the second support container 14*b* is constructed. The strategic locations of the elongated U-shaped slot 50*b*, the elongated locking tab 52*b* and the horizontal self panel 34*b*', when constructed, provide a length, width, and height for the display chamber 36 that permits the tray 18 or the two of the product containers 16 to be placed therein. To construct blank B2, the side walls 26*c*', 26*d*' are folded along respective fold lines 54*c*, 54*d* so that they are positioned at right angle with respect to the back wall 28*b*'. Next, the horizontal shelf panel 34*b*' and the elongated locking tab 52*b* are simultaneously folded downwardly along the fold line 56*c* such that the elongated locking tab 52*b* is folded along the fold line 56*d* and be inserted into the elongated U-shaped slot 50*b*. The first support container 14*b* is constructed such that the dimension of the open top 32*b* corresponds exactly to the dimension of one of the product containers 16.

Figure 4A:
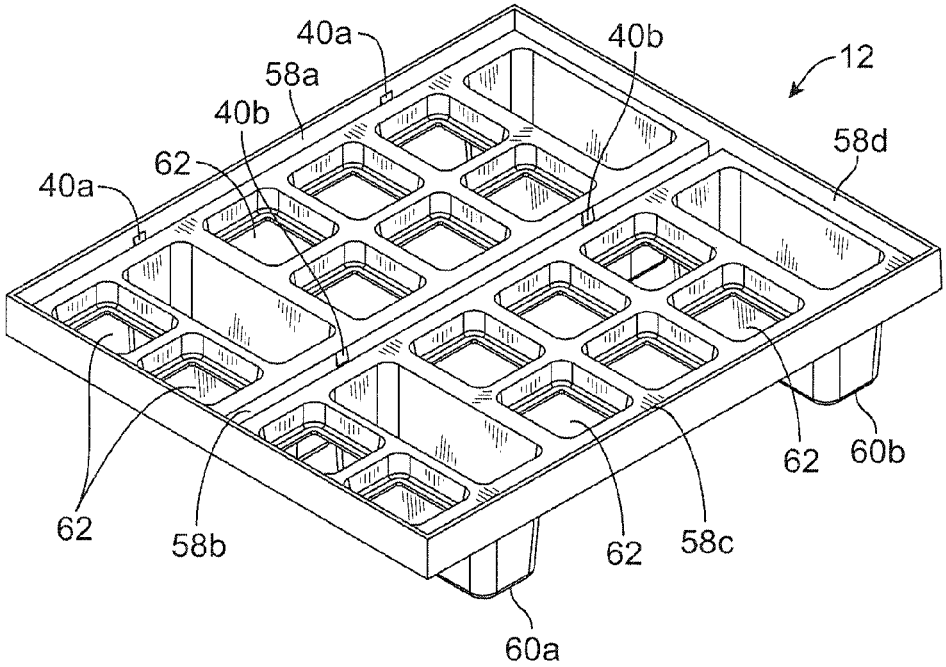
FIG. 4A is a top perspective view of the pallet shown in FIG. 1 in accordance to the preferred embodiment of the invention.
Figure 4B:
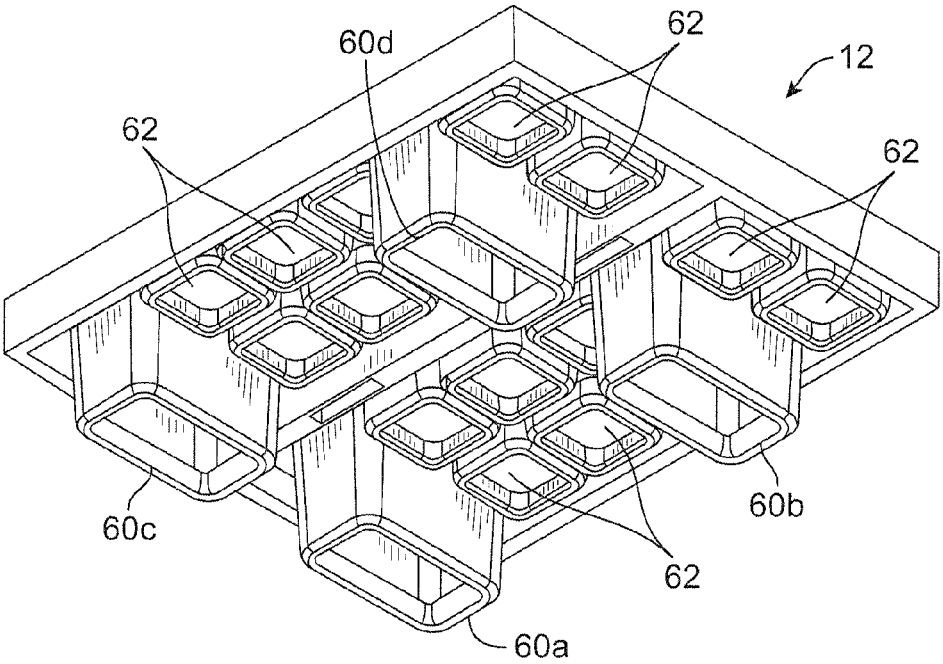
FIG. 4B is the similar to FIG. 4A shown the underneath of the pallet.

FIGS. 4A and 4B are respective top and bottom perspective views of the pallet 12 shown in FIG. 1 in accordance to the preferred embodiment of the invention. The pallet 12 is generally rectangular in shape and is manufactured by injection molding process and is preferably made of modified polypropylene. However, other plastic materials or manufacturing process such as vacuum forming can be used to make the pallet 12. The plastic pallet 12 has several advantages such as lighter weight, ability to be easily sanitized, and resistance to odor when compared to a wood pallet. The pallet 12 is sized and shaped so that it corresponds to the size and shape of the first and second support containers 14*a*, 14*b* and the stacked product containers 16 which are placed on the pallet. The pallet 12 includes four integrated legs 60*a*, 60*b*, 60*c*, and 60*d* each of which formed on each corner of the rectangularly-shaped pallet 12 and support the entire weight of the palletized shipping and display system 10. Each of the legs 60*a*, 60*b*, 60*c*, and 60*d* is formed with large footprint so that there is enough floor contact for palletized shipping and display system 10 to be used as a stand-alone system. Furthermore, the pallet 12 also includes several open-ended wells 62 which are formed therein to substantially enhance the strength of the pallet for carrying heavier products as depicted in FIG. 4B. In addition, the configuration of the open-ended wells 62 substantially reduces the cost of the materials used to make the pallet 12.

Figure 5:
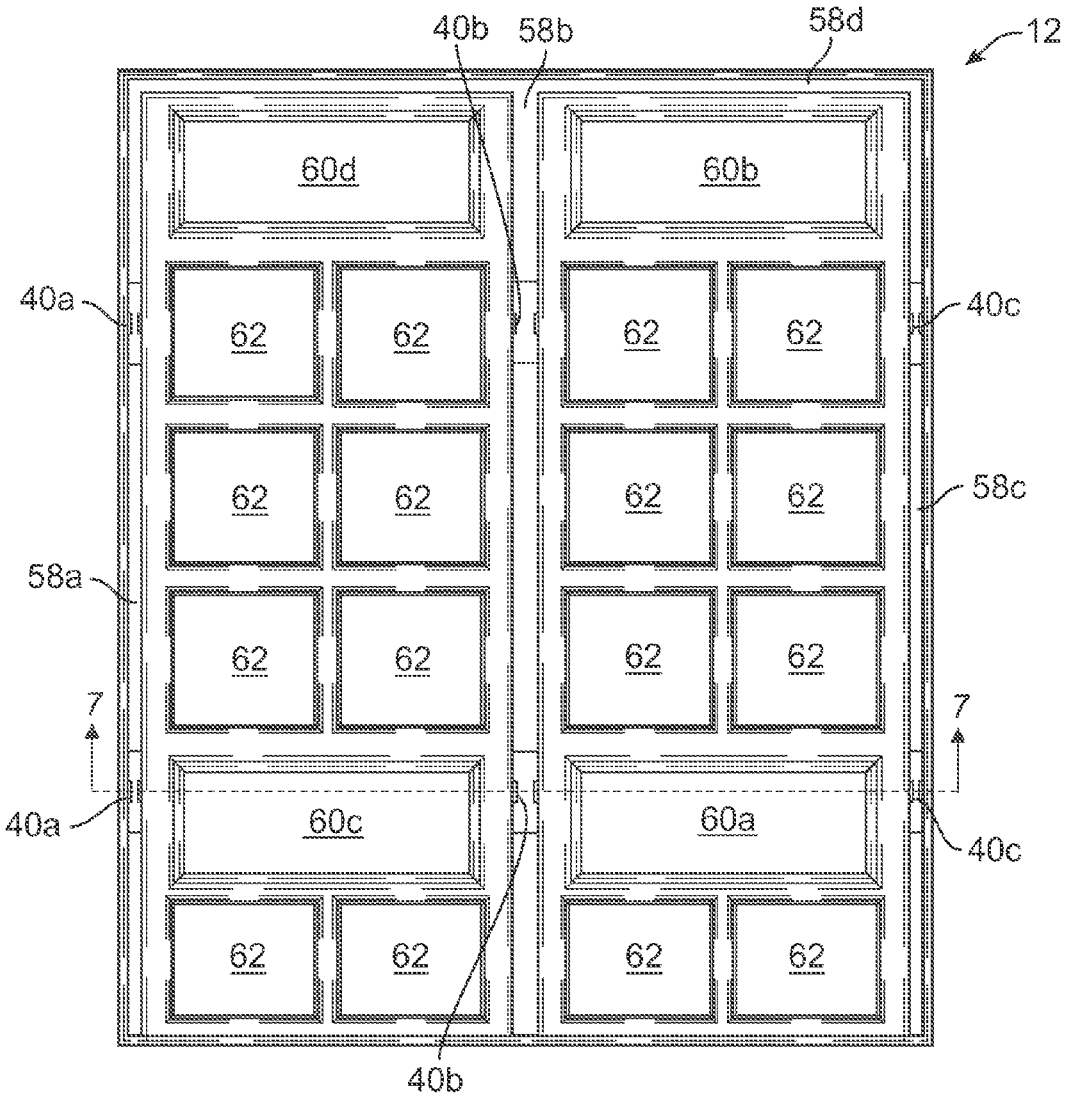
FIG. 5 is a top plan view of the pallet shown in FIG. 4 illustrating the locations of clips integrally attached to the pallet.
Figure 6:
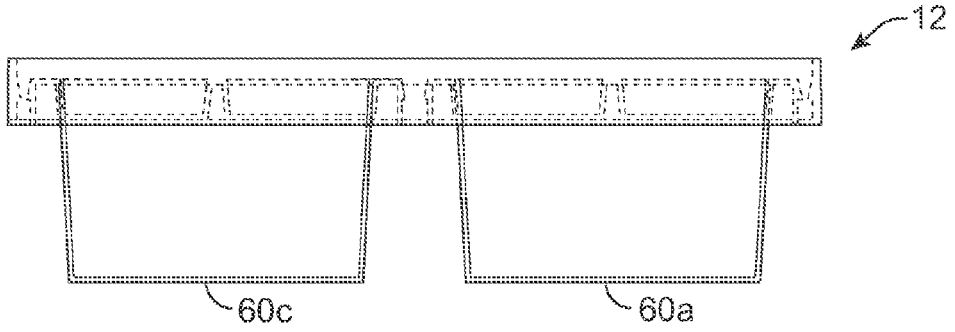
FIG. 6 is a front elevation view of the pallet shown in FIG. 5.

FIG. 5 is a top plan view of the pallet 12 shown in FIG. 4 illustrating the locations of clips integrally attached to the pallet 12. The pallet 12 includes channels 58*a*, 58*b*, 58*c*, and 58*d* formed on the inner sides and at one end thereof. As noted above, the pallet 12 further includes the plurality of spaced apart integrated clips 40*a*,40*b*, and 40*c*formed inside the channels 58*a*, 58*b*, and 58*c*. Each of the respective channels 58*a*, 58*b*, and 58*c* includes two pairs of respective integrated clips 40*a*, 40*b*, and 40*c* formed at positions that correspond to the respective notches 38*a*, 38*b*, 38*c*, and 38*d* on the respective opposite side walls 26*a*, 26*b*; 26*c*, 26*d*. For example, the two pairs of integrated clips 40*a* are formed in the channel 58*a*, the two pairs of integrated clips 40*b* are formed in the channel 58*b*, and the two pairs of integrated clips 40*c* are formed in the channel 58*c*. The channel 58*d* receives the back of the first and second support containers 14*a*, 14*b*. The front elevation view of the pallet 12 in FIG. 6 illustrates the height of each of the two integrated legs 60*a* and 60*c* that provides maximum stability and safety when the palletized shipping and display system 10 is in display in the retail store.

Figure 7:
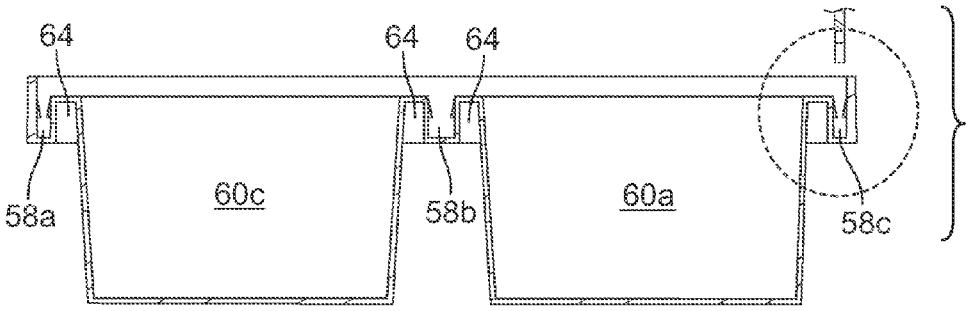
FIG. 7 is a cross-section of the pallet taken along line 5-5 in FIG. 5 with a fragmentary of the support container in a spaced relationship.
Figure 8:
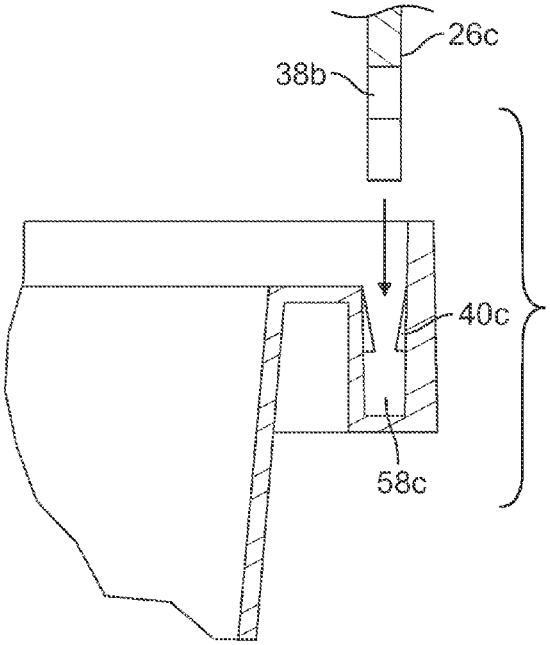
FIG. 8 is an exploded view of an enlarged, partial, sectional view of the pallet and the fragmentary of the support container configured to be engaged with one another.
Figure 9:
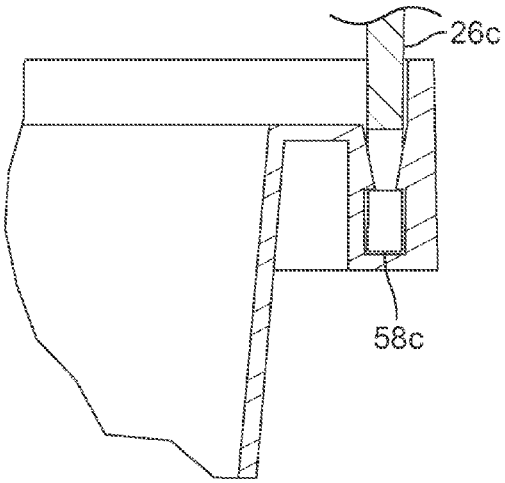
FIG. 9 is similar to FIG. 8 illustrating a portion of one of the support containers is latched at its bottom to the pallet.

FIG. 7 is a cross-section of the pallet taken along line 5-5 in FIG. 5 with a fragmentary of the support container in spaced relationship. FIGS. 7-9 also illustrate the manner in which the exemplary portion of side wall 26*c* having the notch 38*b* is inserted into the channel 58*c* and locked in by the integrated clips 40*c*. When the side wall 26*c* is inserted in the channel 58*c*, the clips 40*c* is biased outwardly so that to permit the side wall 26*c* moves downwardly until the end edge of the side wall 26*c* sits in the U-shaped channel 58*c* and notch 38*b* are the clips 40*c* are fully engaged with one another as seen best in FIGS. 8 and 9. It should also be noted that the inverted U-shaped cavity 64 next to the channels are particularly formed to enhance and accommodate the stress distribution across the surface of the pallet 12.

To assemble and use the palletized shipping and display system 10, the pallet 12 is laid horizontally and each of the first and second support containers 14*a*, 14*b* is is latched at its bottom to the pallet 12. Next, the plurality of product containers 16 containing products 22 are disposed inside each of the two contiguous U-shaped storages 42*a* and 42*b* in a stacking manner and the product tray containing products 22 is placed into the display chamber 36 in the open top as depicted in FIGS. 2B & 3C. Finally, the open-ended tubular sleeve 20 is disposed around the first and second support containers 14*a*, 14*b* and the stacked product containers 16 and is supported at its lower end 44 on the pallet 12 and at its upper end 46 is folded down to securely attach the sleeve 20 to the product tray 18 and first and second support containers 14*a*, 14*b* with the shipping lid 24 enclosing the palletized shipping and display system 10 for shipping and transportation as depicted in FIGS. 2C-2E. At the retail store, the shipping lid 24 is removed and the sleeve 20 is pushed down to expose the products 22 at the open top and to conceal the pallet 12 during the display at point of sale. It should be noted that when the product 22 is depleted from the display chamber 18, the sleeve 20 is lifted to expose and retrieve product containers 16 from the bottom of the stack. The retrieved product containers 16 are then used to replenish product 22 in the display chamber 18.

While the invention has been described and illustrated with reference to one or more preferred embodiments thereof, it is not the intention of the Applicants that the invention be restricted to such detail. Rather, it is the intention of the Applicants that the invention be defined by all equivalents, both suggested hereby and known to those of ordinary skill in the art, of the preferred embodiments. For example, the pallet size may be changed so that it contains different number of support containers or the size of support container may be changed so that it corresponds to the size of the product containers.

What is claimed is:

1. A palletized shipping and display system, comprising:

a pallet;

at least one support container being supported on top of the pallet and having opposite side walls, a back wall, an open front, an open top, and a horizontal shelf extending between the side walls and spaced below the open top to define a product display chamber at the open top;

detent means on a bottom end of the at least one support container for cooperation with complementary detent means on the pallet to hold the at least one support container to the pallet wherein the detent means on the bottom end of the at least one support container is a pair of spaced apart notches formed on respective opposite side walls and wherein the detent means on the pallet is six pairs of spaced apart integrated clips formed on the pallet in which the notches on the two support containers are engaged with the integrated clips;

a plurality of product containers stacked in the support container; and an open-ended tubular sleeve disposed around the at least one support container and the stacked product containers, the open-ended tubular sleeve being supported at a lower end on the pallet and extending at an upper end to the open top, the open-ended tubular sleeve closing the open front to retain the stacked product containers in place while leaving the display chamber exposed through the open top, the open-ended tubular sleeve being slidable upwardly to enable product containers to be withdrawn from the bottom of the stacked product containers and placed in the display chamber as product is depleted from the display chamber.

2. The system of claim 1 wherein at least one support container includes two support containers each having a generally U-shaped horizontal cross-section and the two support containers are contiguously being supported on top of the pallet.

3. The system of claim 1 further comprising a product tray that rests on the product display chamber at the open top.

4. The system of claim 1 wherein the plurality of the product containers are defined by six product containers wherein two of the plurality of product containers is disposed into the product display chamber at the open top.

5. The system of claim 1 further comprising a shipping lid placed on the open-ended tubular sleeve to enclose the tray.

6. The system of claim 1 wherein the opposite side walls of the at least one support container is defined by a first side wall and a second side wall wherein the first side wall includes an elongated locking tab and the horizontal shelf panel that defined by two parallel spaced apart fold lines formed therein and wherein the second side wall includes an elongated slot formed laterally on an upper portion thereof.

7. The system of claim 6 wherein the elongated locking tab is inserted into the elongated slot to form the horizontal shelf.

8. The system of claim 1 wherein the pallet includes four channels formed around the inner sides, middle portion, and at one end of the pallet wherein the integrated clips are formed inside the inner sides and the middle portion.

9. The system of claim 8 wherein each of the respective channels receives two pairs of respective integrated clips formed at positions that correspond to the respective notches on the respective opposite side walls.

10. The system of claim 1 wherein the pallet includes four integrated legs each formed on each corner of the pallet and support the entire weight of the palletized shipping and display system.

11. The system of claim 1 wherein the pallet further includes several open-ended wells which are formed therein to substantially enhance the strength of the pallet for carrying heavier products.

12. A palletized shipping and display system, comprising:

a pallet comprising a plurality of channels each of which having a plurality of spaced apart integrated clips formed therein;

two support containers each contiguously being supported on top of the pallet and having respective opposite side walls, respective back walls, respective open fronts, respective open tops, and respective horizontal shelves extending between the respective side walls and spaced below the respective open top to define a product display chamber at the respective open top;

detent means on a bottom end of each of the two support containers for cooperation with complementary detent means on the pallet to hold the at least one support container to the pallet;

a product tray containing products configured to be placed in the product display chamber;

a plurality of product containers stacked in the respective support containers; and an open-ended tubular sleeve disposed around the two support containers, the stacked product containers and the product tray, the open-ended tubular sleeve being supported at a lower end on the pallet and extending at an upper end to the open top, the open-ended tubular sleeve closing the open front to retain the stacked product containers in place while leaving the display chamber exposed through the open top, the open-ended tubular sleeve is lifted to expose and remove product from the product containers so that to replenish product in the product tray.

13. The system of claim 12 wherein the detent means on the bottom end of each of the respective support containers is a respective pair of spaced apart notches formed on respective opposite side walls.

14. The system of claim 12 wherein the detent means on the pallet is six pairs of spaced apart integrated clips formed on the pallet wherein the respective spaced apart notches on the two support containers are engaged with the integrated clips.

15. The system of claim 12 wherein the plurality of channels is defined by four channels formed around the inner sides, middle portion, and at one end of the pallet wherein the integrated clips are formed inside the inner sides and the middle portion.

16. A palletized shipping and display system, comprising:

a pallet comprising four channels each of which having two pairs of spaced apart integrated clips formed therein;

first and second support containers each contiguously being supported on top of the pallet and having respective opposite side walls, respective back walls, respective open fronts, respective open tops, and respective horizontal shelves extending between the respective side walls and spaced below the respective open top to define a product display chamber at the respective open top;

a pair of spaced apart notches formed on a bottom end of each of the first and second support containers for cooperation with spaced apart integrated clips on the pallet to hold the first and second support containers to the pallet;

a product tray containing products configured to be placed in the product display chamber;

a plurality of product containers stacked in the respective first and second support containers; and an open-ended tubular sleeve disposed around the two support containers, the stacked product containers and the product tray, the open-ended tubular sleeve being supported at a lower end on the pallet and extending at an upper end to the open top, the open-ended tubular sleeve closing the open front to retain the stacked product containers in place while leaving the display chamber exposed through the open top, the open-ended tubular sleeve is lifted to expose and remove product from the product containers so that to replenish product in the product tray.

17. The system of claim 16 wherein the opposite side walls of the respective first and second support containers is defined by a first side wall and a second side wall wherein the first side wall includes an elongated locking tab and the horizontal shelf panel that defined by two parallel spaced apart fold lines formed therein and wherein the second side wall includes an elongated slot form laterally on an upper portion thereof.

* * * * *